US007422305B2

(12) United States Patent
Wada

(10) Patent No.: US 7,422,305 B2
(45) Date of Patent: Sep. 9, 2008

(54) INKJET RECORDING APPARATUS AND INKJET RECORDING METHOD FOR COMPLEMENT RECORDING

(75) Inventor: Satoshi Wada, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 295 days.

(21) Appl. No.: 11/303,534

(22) Filed: Dec. 16, 2005

(65) Prior Publication Data

US 2006/0139394 A1 Jun. 29, 2006

(30) Foreign Application Priority Data

Dec. 28, 2004 (JP) ..... 2004-381747

(51) Int. Cl.
*B41J 29/393* (2006.01)
*B41J 2/155* (2006.01)

(52) U.S. Cl. ..... 347/19; 347/42

(58) Field of Classification Search ..... 347/19, 347/12, 13, 14, 15, 42
See application file for complete search history.

(56) References Cited

U.S. PATENT DOCUMENTS 6,283,572 B1 * 9/2001 Kumar et al. ..... 347/19
6,652,056 B2 * 11/2003 Shioya ..... 347/12
7,338,144 B2 * 3/2008 Mantell et al. ..... 347/19
2004/0119766 A1 6/2004 Shibata
2005/0046658 A1 * 3/2005 Kojima ..... 347/19

FOREIGN PATENT DOCUMENTS

CN 1490165 4/2004
JP 10-006488 1/1998
JP 10-6488 1/1998
JP 11077986 A * 3/1999
JP 2004-122521 4/2004

* cited by examiner

*Primary Examiner*—Stephen D Meier
*Assistant Examiner*—Rene Garcia, Jr.
(74) *Attorney, Agent, or Firm*—Canon USA Inc I.P. Div

(57) ABSTRACT

An inkjet recording apparatus which utilizes a recording head including a plurality of nozzles arrayed on the head. The present invention complements a point where an image is to be formed by a defective nozzle utilizing other nozzles while preventing the uneven use of nozzles provided in a recording head. Recording is performed utilizing recording heads which have a plurality of nozzles arrayed in a predetermined direction for discharging ink droplets of the same color. If a defective nozzle exists in the recording heads, complement recording is performed utilizing nozzles of the same recording head or other recording heads. As for the nozzles to be employed for the complement, a plurality of complement nozzles among the nozzles located adjacent to the defective nozzle is utilized. By discharging ink droplets from the complement nozzles, a point where an image is to be formed by the defective nozzle is complemented.

9 Claims, 14 Drawing Sheets

FIG.11

| NOZZLE NO. | 1 | 2 | 3 | 4 | 5 | 6 | --------- | n-5 | n-4 | n-3 | n-2 | n-1 | n |
|---|---|---|---|---|---|---|---|---|---|---|---|---|---|
| AREA A | 0 | 0 | 1 | 1 | 1 | 0 | --------- | 1 | 0 | 1 | 1 | 0 | 0 |
| AREA B | 1 | 1 | 0 | 0 | 0 | 1 | --------- | 0 | 0 | 1 | 0 | 0 | 0 |

INKJET RECORDING APPARATUS AND INKJET RECORDING METHOD FOR COMPLEMENT RECORDING

BACKGROUND OF THE INVENTION

1. Field of the Invention

The present invention relates to an inkjet recording apparatus configured to form an image by discharging ink droplets, and, more particularly, to an inkjet recording apparatus which performs recording by discharging ink of the same color from a plurality of long recording heads and an inkjet recording method thereof.

2. Description of the Related Art

A recording apparatus is mainly utilized as an output device in a multiple electronic device or a workstation including a computer or a word processor. The output device is generally called a printer. Further, a recording apparatus is utilized as a recording unit of a copying machine. Recently, a multi function printer in which functions of a printer, a scanner, and a copying machine are integrated has been known. The multifunction printer contains a recording device as an output device which outputs data on recording paper. The output device records an image (including characters, symbols, etc.) on a recording medium such as paper, plastic thin plate, etc. based on recording information. As a recording method adopted for a recording device, a variety of methods has been proposed. For example, an inkjet type, a wire dot type, and a thermal type have been known as recording methods in which a recording head is configured to form a dot on a recording medium based on recording information. Further, a laser beam method which forms an image by irradiating a laser beam to a photosensitive drum based on recording information is also known.

Among these methods, the methods which utilize a recording head are widely used because of a compact and inexpensive structure. As one example of the recording devices which employ a recording head, a so-called serial-type recording apparatus is known which performs recording by moving a recording head in a direction (main scanning direction) intersecting with a sub scanning direction while moving a recording medium in a certain direction (sub scanning direction). The serial-type recording apparatus employs a recording head having relatively narrow recording width. The recording device of this type performs recording on a whole area of the recording medium by repeating a recording operation that scans the recording head along a main scanning direction and a conveying operation that conveys the recording medium in a sub scanning direction. Now, the recording operation of the serial-type recording apparatus is specifically described. In the recording operation, a recording head performs a scanning operation in a main direction against a recording medium which is being stopped and performs recording of an image according to the width of the recording head. When one main scan is completed, the recording medium is conveyed by a predetermined distance, and the recording head performs the next scanning operation against the recording medium which is being stopped. In this manner, by repeating the main-scanning operation to perform recording and the conveyance operation of the recording medium, the image formation on a whole area of the recording medium is performed.

Further, as another example utilizing the recording head, a full-line type recording apparatus is known. The recording head employed for the full-line type recording apparatus has an array of recording elements wider than the width of a recording medium. In the case of the above inkjet type recording apparatus, a head having an array of several thousands of nozzles which discharge ink is fixed to a main body of the apparatus, and a recording medium is conveyed in a direction intersecting with a longitudinal direction of the recording medium to perform the recording operation. In the full-line type recording apparatus, a long recording head records one line of image at one operation while conveying a recording medium sequentially to form an image on a whole area of the recording medium. In the full-line type recording apparatus which employs a recording head of the inkjet type, a recording medium passes the recording head only once to record an image. This recording method in which an image is completely formed by one recording operation is called a one-pass recording.

Among the various above-described recording methods, the inkjet type recording apparatus (inkjet recording apparatus) which performs recording by discharging ink from a recording head has an advantage in that low noise and high-speed recording are possible since non-contact recording between the recording head and recording paper is employed. The inkjet type recording apparatus further has advantages in that downsizing of recording heads is easy, hi-definition images can be formed at a high speed, and a running cost is low since recording is performed with normal paper to which no special treatment is given. Moreover, there is an advantage that by providing recording heads corresponding to a plurality of ink colors, a color-image can be formed readily.

Especially, the full-line type recording apparatus is configured to obtain a recorded image of desirable width by one recording operation, and therefore, an image forming operation can be further sped up. Also, a potential as a device for on-demand printing, for which demands have been recently increasing, is attracting attention. In the on-demand printing, it is not required that several million copies are printed like conventional news papers or magazines. The required printing speed for the on-demand printing is about a hundred thousand of sheets per hour. On the other hand, a labor saving is desired. The full-line recording apparatus is inferior to conventional printers such as an offset printer in printing speed. However, the full-line type recording apparatus has advantages that manpower can be saved because it is not necessary to make printing plates, and small batches of a variety of printings can be dealt with readily in a short time. Thus, the full-line type recording apparatus is suitable for the on-demand printing.

For the full-line type recording utilized in on-demand printing, a high resolution recording grade equal to or more than 600×600 dpi (dot per inch) is required in a case of a black-and white document that consists of sentences, for example. In a case of recording a full-colored image such as a photograph, a high resolution recording grade equal to or more than 1200×1200 dpi is required. As for printing speed of the on-demand printing, for example, in a case of an A3 size recording medium, more than 30 pages per minute is required.

Further, in the on-demand printing, an image is often recorded on several sizes of recording medium. For example, an image captured by a digital camera is recorded on a L-size medium like conventional silver halide photograph or on a small-size medium such as a post card. However, in the full-line type recording apparatus, especially in a full-line printer capable of recording a photo-quality image on large size paper, it is extremely difficult to manufacture discharge openings and inkjet recording elements all without any defect over the whole width of a recording area. For example, in order to perform recording on recording paper of A3 size in a density of 1200 dpi, about 14000 discharge openings (the recording width is about 280 mm) are required for the full-line type recording head. Accordingly, it is extremely difficult to process such a great number of ink discharge openings and their corresponding inkjet recording elements without a single defect in its manufacturing process. Even if such process is possible, there is the possibility that a non-defective rate becomes low and a manufacturing cost immensely increases.

Accordingly, it should be assumed that defective nozzles exist within a printing head mounted on the full-line type recording apparatus, and it has been proposed that a plurality of recording heads of the same color are arranged so as to complement the defective nozzles.

Japanese patent application laid-open No. 10-6488 discloses a structure configured to complement an area where recording is not performed due to a defective nozzle. More particularly, the patent document discusses a technique that complements a defective discharge nozzle on a recording head by a nozzle located on the same raster of the other recording head.

However, when the defective nozzle is complemented according to the technique disclosed in the above patent document, the nozzle that complements the defective nozzle is extremely frequently used, which accelerates a secular change and results in shortening the nozzle life.

SUMMARY OF THE INVENTION

The present invention is directed to an inkjet recording apparatus and an inkjet recording method.

The inkjet recording apparatus and the inkjet recording method allows for complementing a defective nozzle by utilizing other nozzles while reducing uneven frequency of use of nozzles provided on a recording head.

In one aspect of the present invention, an inkjet recording apparatus includes a recording unit. The recording unit includes a plurality of recording heads each having a plurality of nozzles configured to discharge ink droplets. The nozzles of each recording head are arrayed along a predetermined direction, and the plurality of recording heads is arranged in a direction different from an arraying direction of the plurality of nozzles. The recording unit and a recording medium are moved relatively in a direction intersecting with the arraying direction of the nozzles during recording. The inkjet recording apparatus also includes a complement unit configured to perform complement recording on a corresponding point on the recording medium where an image is to be formed by any defective nozzle of the nozzles arrayed in the recording heads by employing a complement nozzle selected from the nozzles adjacent to the defective nozzle.

In another aspect of the present invention, an inkjet recording method which utilizes a recording unit. The recording unit includes a plurality of recording heads having a plurality of nozzles configured to discharge ink droplets, the nozzles being arrayed along a predetermined direction and the recording heads are arranged in a direction different from the arraying direction of the nozzles. The recording unit and a recording medium are moved relatively in a direction intersecting with the arraying direction of the nozzles so as to perform recording by discharging ink droplets on the recording medium from the nozzles. The inkjet recording method includes a step of selecting a plurality of complement nozzles to be utilized for performing complement recording from nozzles adjacent to any defective nozzle. The inkjet recording method also includes a complementing step of performing complement recording to a position on the recording medium where an image is to be formed by the defective nozzle by utilizing the complement nozzles.

In the present invention, "recording" means not only to form significant information such as characters and drawings but also includes images, designs, patterns, etc. on a recording medium or to arrange a medium.

Further, the images, designs, and patterns to be formed may be significant or insignificant and also they may be actualized to be visually perceivable or not.

In the present invention, "recording medium" includes not only paper generally used for an inkjet recording apparatus but also includes cloths, plastic films, metal plates, and materials capable of receiving ink discharged from the recording heads.

Further, "ink" should be construed broadly similar to the above definition of "recording", which includes liquids capable of forming images, designs, and patterns or processing a recording medium when applied on a recording medium.

In the present invention, it is possible to obtain hi-quality images even if a defective nozzle exists in the recording head by complementing a point where an image is to be formed by the defective nozzle utilizing a plurality of nozzles adjacent to the defective nozzle. Further, the life of heads can be increased by reducing concentration of a load on a particular nozzle.

Moreover, if a nozzle for complement is determined on the basis of frequency of use of a nozzle or an impact accuracy of a nozzle, the frequency of use of nozzles can be averaged surely and the complement can be performed more properly.

Further features of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate embodiments of the invention and, together with the description, serve to explain the principles of the invention.

FIG. 11 illustrates an example of 2-bit selection data corresponding to respective nozzles.

DETAILED DESCRIPTION OF THE EMBODIMENTS

Embodiments of the invention will be described in detail below with reference to the drawings.

First Embodiment

Figure 1:
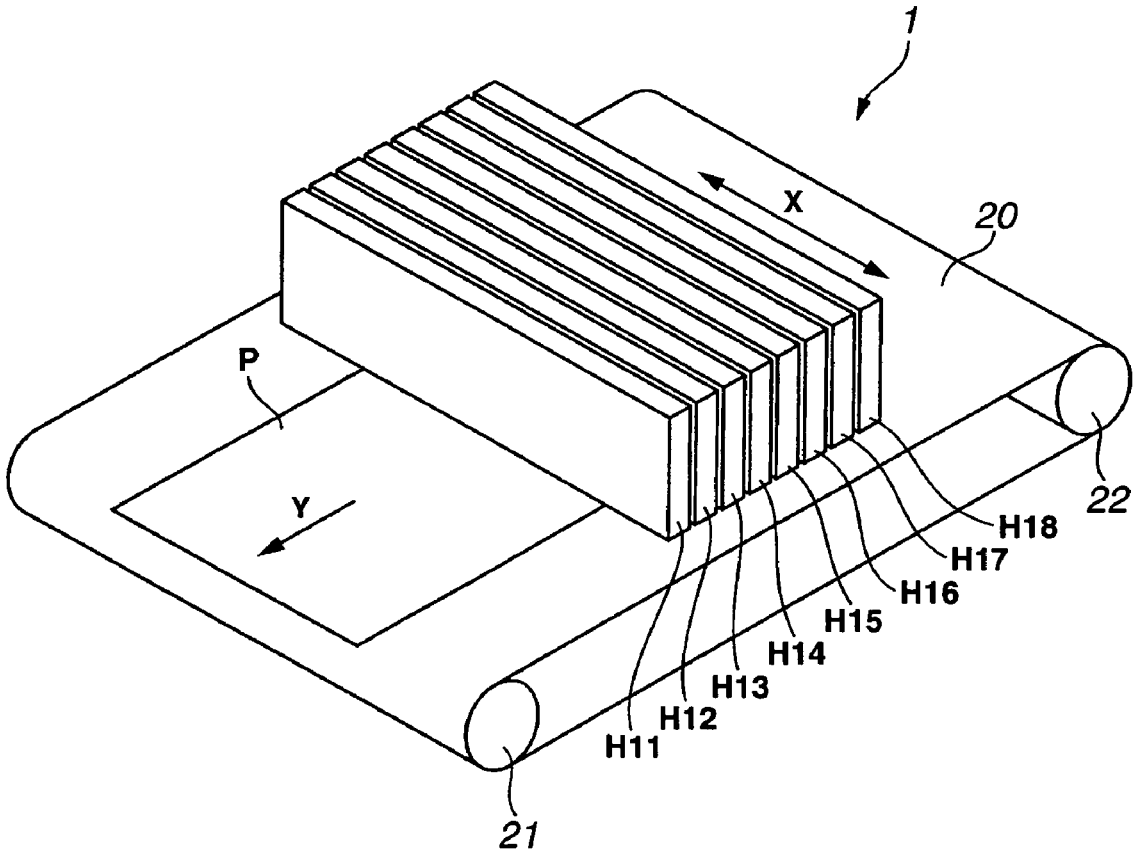
FIG. 1 is a perspective view schematically illustrating an example of a full-line type inkjet recording apparatus applied to embodiments of the present invention.

FIG. 1 is a perspective view schematically illustrating an example of a full-line type inkjet recording apparatus to be applied to embodiments of the present invention.

An inkjet recording apparatus 1 has long recording heads H11 to H18 arranged in parallel corresponding to a plurality of color ink. In the recording heads, a plurality of ports for discharging ink (hereinafter referred to as a nozzle) is arrayed. In a direction intersecting with an X-direction, which is a longitudinal direction of the recording heads (i.e. a direction in which the discharging ports are arrayed), an endless conveyance belt 20 is provided as a conveying section for conveying a recording medium P. The conveyance belt 20 winds around two rollers 21 and 22, and one of the two rollers is circulated by a continuously rotating drive motor (not shown) so as to continuously convey the recording medium P in a Y-direction.

The inkjet recording apparatus 1 in the present embodiment forms a color image by discharging inks of Cyan (C), Magenta (M), Yellow (Y), and Black (B), and two recording heads are arranged per color. In FIG. 1, H11 and H12 are two recording heads which discharge cyan ink, and H13 and H14 are two recording heads which discharge magenta ink. In FIG. 1, H15 and H16 are two recording heads which discharge yellow ink, and H17 and H18 are two recording heads which discharge black ink. Hereinafter, only a symbol H is used if there is no necessity of distinguishing each recording head.

In above described inkjet recording apparatus, the recording medium P is fed onto the conveyance belt 20 by a feeding mechanism (not shown). The operations of the feeding mechanism and the recording heads H11 to H18 are controlled by a CPU in a control system which is described below. The recording heads H11 to H18 discharge ink from each nozzle based on the discharge data sent from the control system, and the conveyance belt 20 conveys the recording medium P in synchronization with ink discharge operations of the recording heads H11 to H18. As a result of the conveyance of the recording medium P and the ink discharge, an image is formed on the recording medium P.

Figure 2:
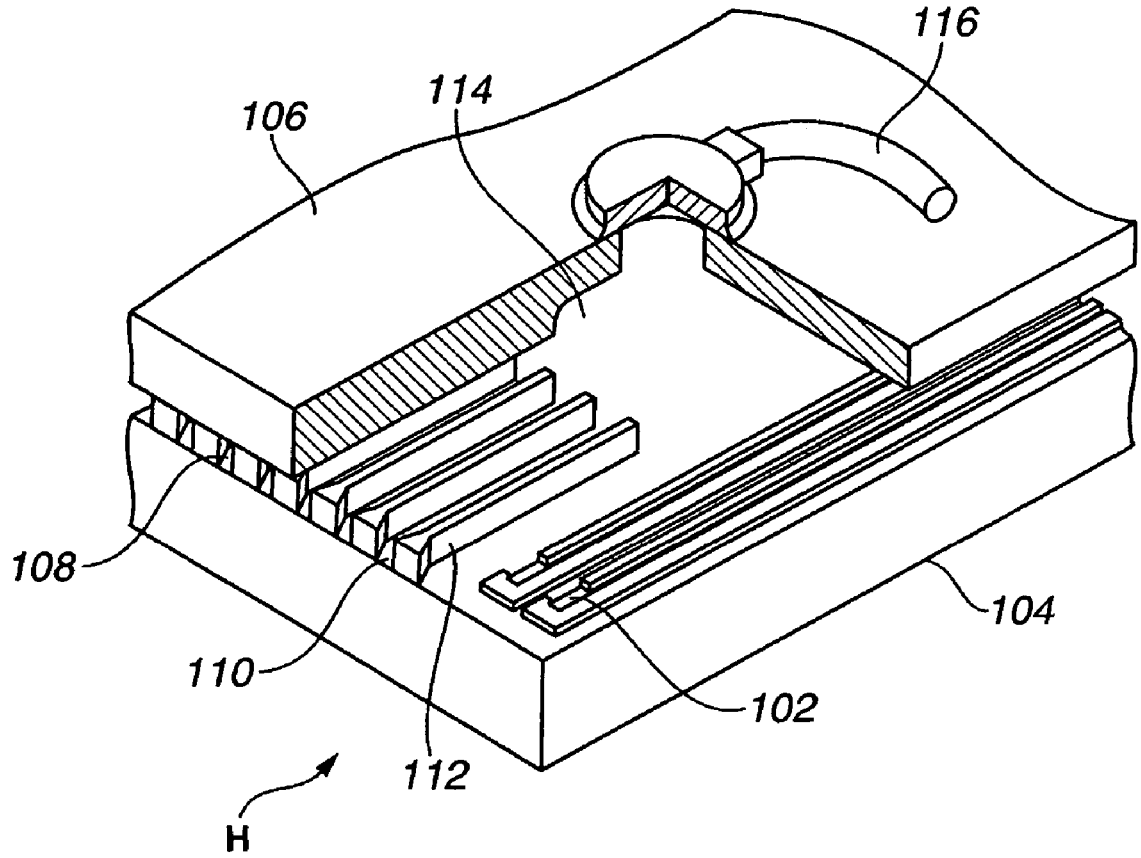
FIG. 2 is a partial cutaway perspective view illustrating an internal structure of the recording head shown in FIG. 1.

Next, an internal structure of the above recording head H is described with reference to FIG. 2. The recording head H according to the embodiment includes a heater board 104, as a substrate, on which a plurality of heaters 102 are formed to heat ink, and a top plate 106 which covers the heater board 104. Under the top plate 106, a plurality of discharge ports 108 are formed, and at the rear of the discharge ports 108, tunnel-shaped liquid paths 110 are formed which communicate with the discharge ports 108. Each liquid path 110 is separated from an adjacent liquid path by a partition wall 112. Each liquid path 110 is commonly communicated with an ink liquid chamber 114 at the rear of each liquid path. Ink is supplied to the ink liquid chamber 114 through an ink supply port 116, and then the ink is supplied to each liquid path 110 from the ink liquid chamber 114. The heater board 104 and the top plate 106 are engaged with each other so that each heater 102 is located at a position corresponding to each liquid path. In FIG. 2, only two heaters are shown, however, each heater 102 is placed respectively corresponding to each liquid path 110.

Figure 3:
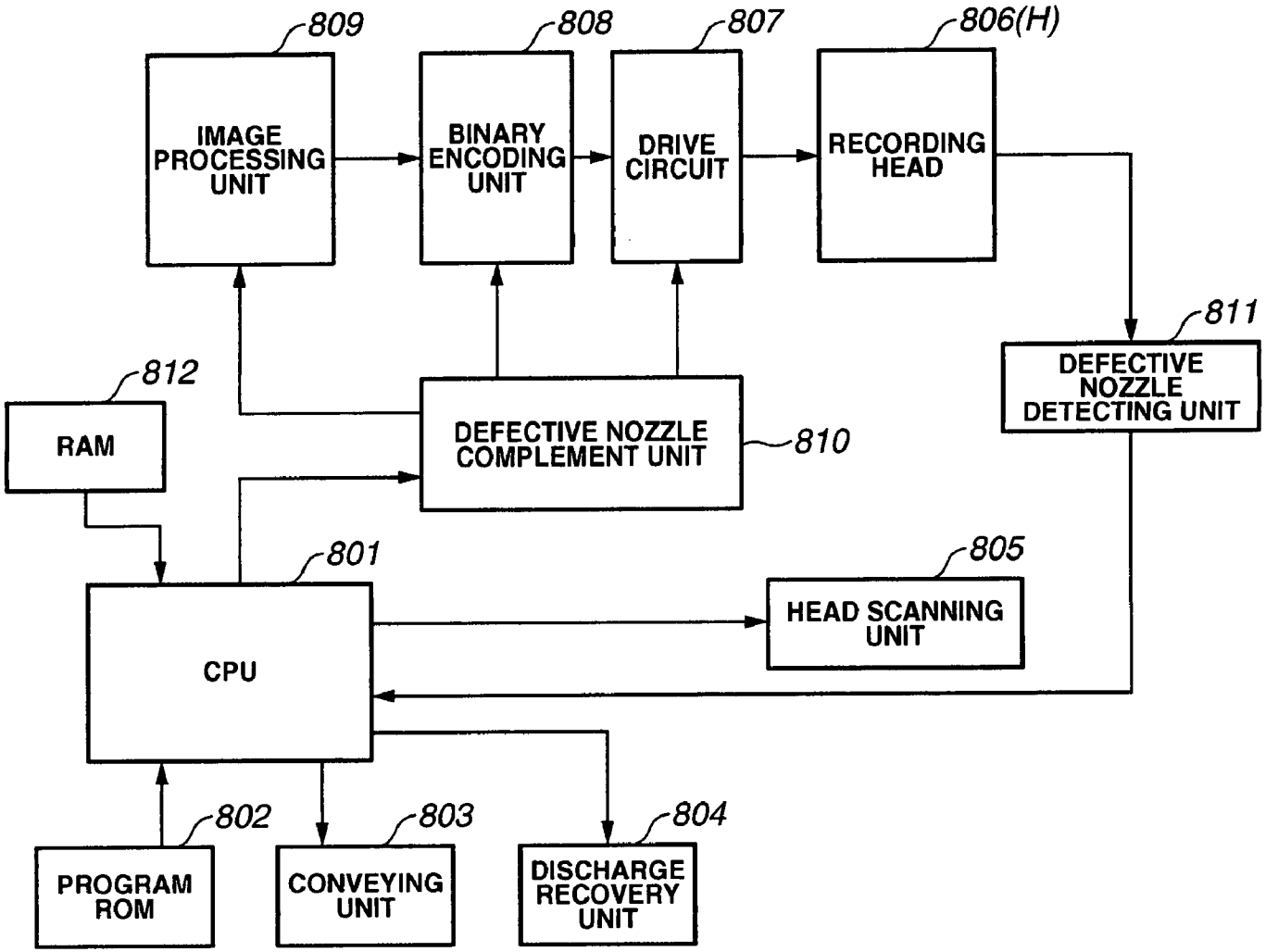
FIG. 3 is a block diagram illustrating a general structure of a control system in an inkjet recording apparatus according to the embodiments of the present invention.

When a predetermined drive pulse is supplied to the heater 102 in the engaged state in FIG. 2, the ink on the heater 102 is boiled to form bubbles, and is pushed and discharged from the discharge port 108 by cubical expansion of the bubbles. The heater board 104 is manufactured by a semiconductor process on a base of a silicon substrate, and a signal line for driving the heater 102 is connected to a drive circuit 807 (see FIG. 3) which is formed on the same substrate. A nozzle (discharge portion) includes the discharge port 108, heater 102, and liquid path 110. A general structure of a control system of an inkjet recording apparatus according to embodiments of the present invention is shown in FIG. 3. In FIG. 3, a CPU 801 controls a whole system, and a software program for controlling the system is written in a ROM 802. In FIG. 3, a RAM 812 temporarily stores processing data or input data of the CPU 801, and a conveying unit 803 conveys a recording medium (recording paper, OHP film etc.). A recording head 806 has arrayed nozzles for discharging ink droplets, and a discharge recovery unit 804 recovers discharge of the recording head 806.

An image processing unit 809 performs predetermined image processing to an inputted color image data which should be recorded. In the image processing unit 809, for example, data conversion is performed so that a color area reproduced by image data of inputted R, G, B data, etc. is incorporated into a color area reproduced by a recording apparatus. Further, the image processing unit 809 obtains color separation data Y, M, C, K, etc. based on the converted data according to a combination of ink which reproduces colors of the data. Then, the image processing unit 809 performs a gray scale conversion to the color separation data which is separated into each color. The multi-valued image data converted by the image processing unit 809 is converted into discharge data (bitmap data) after a halftone process is performed in a binary encoding unit 808. A drive circuit 807 causes discharge of ink droplets in a recording head 806 based on the discharge data obtained by the binary encoding unit 808.

A defective nozzle complement unit 810 forms complement data of a defective nozzle (hereinafter referred to as complement process). The defective nozzle complement unit 810 counts the total discharge number of each nozzle (accumulated number of discharge) while the complement process is performed, and stores the counted number. A defective nozzle detecting unit 811 detects a nozzle (defective nozzle) in which the discharge state of ink droplet is inadequate, among a plurality of nozzles formed in the recording head 806.

When a defective nozzle detecting pattern is formed on a recording medium, the defective nozzle detecting pattern data stored in the RAM 812 is read out by the CPU 801, and the ink is discharged from each nozzle of a recording head H based on the data. When the pattern is recorded, each nozzle in the recording head H is driven through the drive circuit 807 based on the readout pattern data, and each unit concerning the recording operation, such as a head scanning unit 805, is driven.

Figure 4:
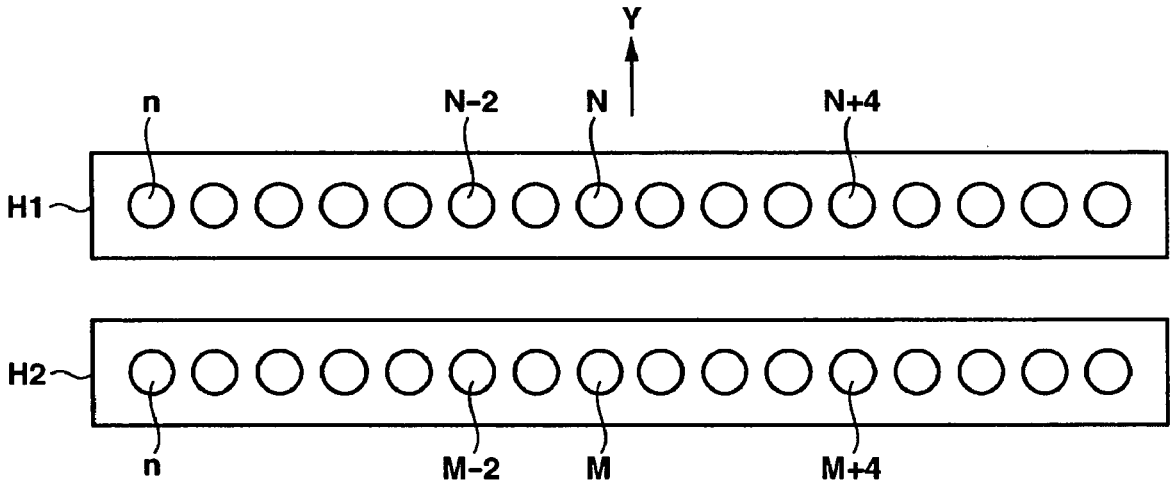
FIG. 4 is a schematic view illustrating a nozzle arrangement in a recording head according to embodiments of the present invention.

Next, an arrangement of nozzles within a recording head according to the embodiment and a method of detecting a defective nozzle in the recording head are described with reference to FIG. 4 and FIG. 5. First, the arrangement of nozzles in a recording head which discharges the ink of a same color according to the embodiment is described with reference to FIG. 4. As described above, according to the present embodiment, an image is formed by discharging the ink of the same color from two recording heads, H1 (a first recording head) and H2 (a second recording head). On each of recording heads H1 and H2, a plurality of nozzles (n) are arrayed in a direction intersecting with a conveying direction Y of a recording medium P. A nozzle n in one recording head and a nozzle n in another recording head are arranged to be located at a same position in a nozzle arraying direction X. That is, each nozzle in both recording heads forms a dot at the same position on the recording medium.

A method of detecting a defective nozzle that is performed in the defective nozzle detecting unit 811 shown in FIG. 3 will be described. As the method of detecting the defective nozzle existing in the recording head, for example, two methods can be considered as described below.

In a first method, a circuit which detects a temperature of the heater board 104 of the recording head H described in FIG. 2 is formed directly beneath the heater board 104 for each nozzle. In this method, the detection is performed based on a temperature of the heater board 104. Namely, a temperature change of the heater board 104 is analyzed, and based on the analysis result, a defective nozzle is detected in which ink droplets cannot be discharged (hereinafter referred to as an inoperative state) or an amount of discharge of ink droplets is less than an adequate amount. Generally, in a case of a recording head which discharges ink utilizing thermal energy (thermal head), it is confirmed by experiment that a temperature rise of a heater board caused by the above defective nozzle becomes higher than a normal nozzle. Therefore, it is possible to determine the defective or normal nozzle based on information about a temperature detected by each circuit. An advantage of the first detecting method is that a state of a nozzle in a recording operation can be detected in real time.

In a second method, a defective nozzle detecting pattern on a recording medium is recorded regularly (for example, right after a recording apparatus is put to use), and the nozzle defective pattern is read utilizing a optical unit such as a scanner so that defects such as the inoperative state can be detected. The defective nozzle detecting pattern formed on a recording medium in the second method is shown in FIG. 5 as an example. The defective nozzle detecting pattern in the figure shows lines which have a certain length formed at certain positions on a recording medium by each nozzle of the first recording head H1 and the second recording head H2. PT1 shows a pattern formed by each nozzle of the first recording head H1, and PT2 shows a pattern formed by each nozzle of the second recording head H2.

When the defective nozzle detecting pattern is optically detected, the nozzle N−2 in the first recording head H1 is in an inoperative state, and the nozzle M+4 in the second recording head H2 has a characteristic that the discharge direction of droplets is displaced to the right nozzle.

As described above, the second method enables to detect not only a inoperative nozzle but also a nozzle which has a characteristic of large displacement by forming the defective nozzle detecting pattern. Because large displacement of an impact position of an ink droplet is one of the factors which bring deterioration of image quality, the nozzle having a characteristic of large displacement should be considered as a defective nozzle and included in nozzles to be complemented.

Figure 6A:
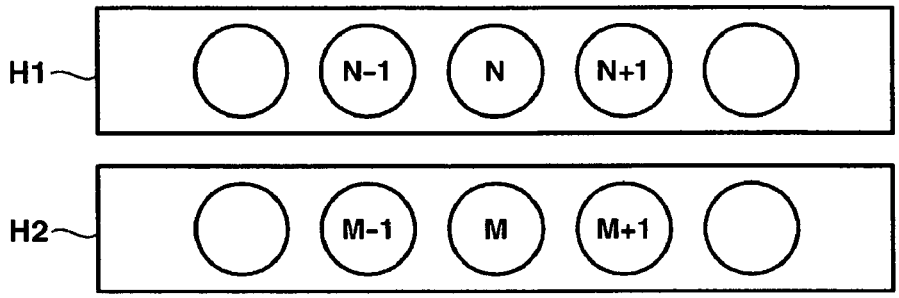
FIGS. 6A and 6B illustrate a state in which a recording operation is performed without making any complement when a defective nozzle appears in a conventional recording head.
Figure 6B:
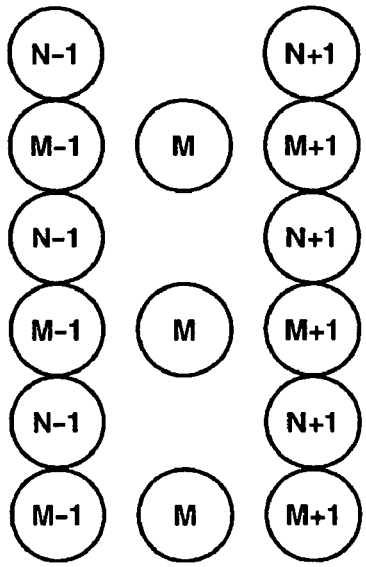

Next, a method of complementing an image in a case where a defective nozzle exists will be described. FIGS. 6A and 6B illustrate a recording operation performed without any complement when a recording head has a defective nozzle.

The two recording heads H1 and H2 in FIG. 6A discharge ink of a same color, and FIG. 6B shows the dots formed when the nozzle N in the first recording head H1 is in an inoperative state. Here, a successive raster (a line in Y direction (conveying direction of recording medium) in FIG. 1) is recorded utilizing each nozzle of the two recording heads H1 and H2 alternatively.

As shown in FIG. 6B, in the raster recorded by the recording head H1, the dots are missing which should be formed by the nozzle N which is in the inoperative state. In this state, low-density areas are formed on a raster that corresponds to the nozzle N and results in reduction in image quality. In order to solve the problem, conventionally, the nozzle N in inoperative state is complemented by other nozzles having proper discharge performance.

Figure 7A:
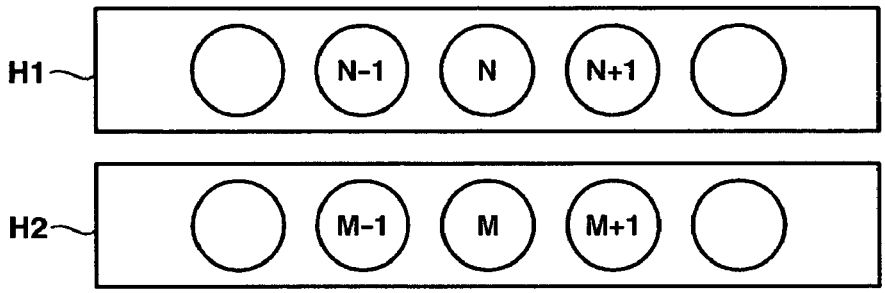
FIG.7A PRIOR ART
FIGS. 7A and 7B illustrate a conventional example of a method for complementing an image.
Figure 7B:
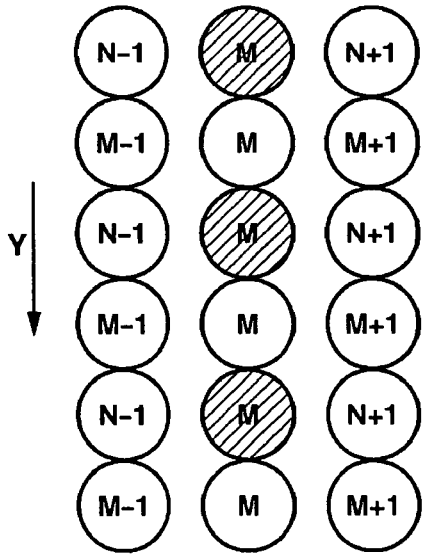
FIG.7B PRIOR ART

FIGS. 7A and 7B illustrate the conventional method of complementing an image. As shown in the figures, in the conventional complement method, a nozzle opposing the nozzle N which is in inoperative state, that is, the nozzle M which forms the same raster together with the nozzle N, performs recording instead of the nozzle N. This image complement method forms an image in ideal quality in an inkjet recording apparatus having a plurality of recording heads which discharge ink of the same color. However, according to the method, an accumulated discharge number of the nozzle M (frequency of use) increases substantially than the other nozzles which, as a result, significantly accelerates deterioration (decreasing the life) of the nozzle M. In order to solve the problem, according to the first embodiment of the present invention, when a nozzle in the inoperative state exists, the discharge operation is allotted to a plurality of nozzles adjacent to the nozzle in the inoperative state so that the frequency of use of a particular nozzle shown in the above described conventional method decreases.

Figure 8A:
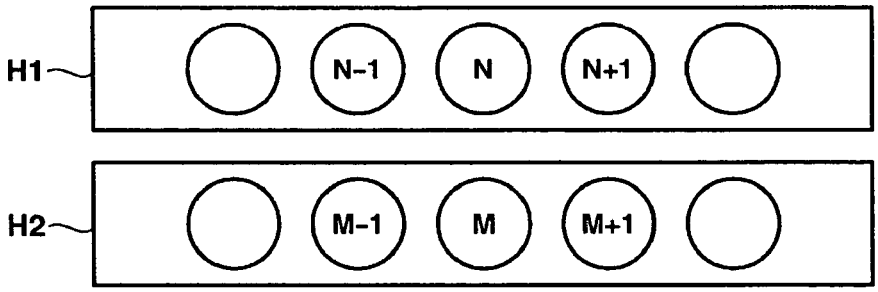
FIGS. 8A and 8B schematically illustrate a method for complementing an image according to a first embodiment of the present invention.
Figure 8B:
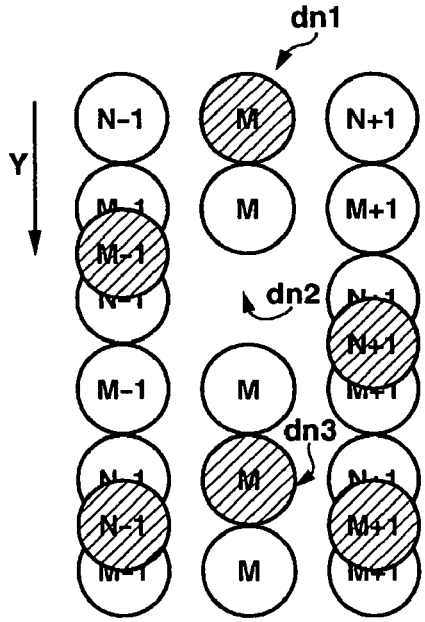

FIG. 8A and FIG. 8B schematically illustrate a method of complementing an image according to the first embodiment of the present invention. With respect to the two recording heads shown in FIG. 8A, when the nozzle N in the recording head H1 is in the inoperative state, a total of five nozzles which are adjacent to the inoperative nozzle N is utilized for complement. The five nozzles are, as shown in FIG. 8A: (i) N−1 and N+1, which are first and second nozzles positioned next to the inoperative nozzle N, (ii) a third nozzle M which forms the same raster as the inoperative nozzle N, and (iii) M−1 and M+1, which are a fourth and a fifth nozzles positioned adjacent to the inoperative nozzle N. The embodiment is not limited to the configuration which utilizes all of five nozzles to complement the image. Instead, a plurality of nozzles out of the five nozzles can be selected as a complement nozzle. In the embodiment, all of the five nozzles are utilized as complement nozzles. When complementing a point on which a plurality of dots is to be formed by a defective nozzle, at least one of the complement nozzles is utilized. That is, in order to complement points on which a plurality of dots are to be formed by a defective nozzle, not only the nozzle M which forms the same raster as the inoperative nozzle N but also the four adjacent nozzles except the nozzle M, that is, N−1, N+1, M−1, and M+1 are employed for complement. The complement is performed by increasing the number of discharge of the complement nozzles from the normal number of discharge. Hereinafter, the complement performed by a plurality of nozzles adjacent to the inoperative nozzle is referred to as "adjacent complement".

As described above, in a normal operation, each recording head of H1 and H2 is alternately used to form an image. Accordingly, a so-called recording is performed on 50% duty, that is, each recording head forms a raster every other dot. On the other hand, in a case where a defective nozzle is complemented, the ink is discharged so that the two dots (white dots and shaded dots in FIG. 8B) are continuously formed.

For example, in FIG. 8B, among points dn1, dn2, and dn3, where dots to be formed by the nozzle N are missing (points where dots are to be formed by the nozzle N), the missing point dn1 is complemented by a dot formation of the nozzle M. When complementing the missing point dn2, dots are formed successively by the nozzle M−1 and the nozzle N+1. Therefore, on a point where a dot is formed by the nozzle N−1, ink droplets discharged from both of the nozzles N−1 and M−1 are impacted to overlap with each other. In addition, on a point where a dot is formed by the nozzle N+1, ink droplets discharged from both of the nozzles N+1 and M+1 are impacted. In the FIG. 8B, for reasons of notation, the complement dots formed by nozzles except for the nozzle M (shaded dots) are illustrated to be formed between adjacent dots (two adjacent white dots). However, in reality, the shaded dot and another white dot are formed at almost the same position by discharged ink droplets in an overlapping manner.

Thus, two ink droplets are impacted onto the same point, and accordingly, a greater amount of ink than normal is applied around the missing point dn2 which causes wide spread of ink at each ink impact position. Consequently, the missing point dn2 is complemented with the wide spread of ink. When complementing the missing point dn3, dots are formed successively by the nozzle N−1 and the nozzle M+1. Further, at the points where dots are to be formed by the nozzle M-1 and the nozzle N+1, two ink droplets overlap with each other. Accordingly, the missing point dn3 is complemented with the wide spread of ink.

In FIG. 8B, in order to specifically illustrate positions to be formed by each nozzle, diameters of dots are smaller than those actually formed on a recording medium. Therefore, on the drawing, it looks like that the effect of adjacent complement to an inoperative nozzle N can not be expected (the missing point of the dot cannot be complemented). However, diameters of dots actually formed on the recording medium are larger than the diameters illustrated in FIG. 8B so that the ink can fully cover a surface of paper. Therefore, it has been confirmed that the missing points of an image can be fully complemented since adjacent dots fully overlap with each other, and the complement effect by the adjacent dots can be achieved.

Further, recording data for partially executing the above successive discharge is stored in advance in each print buffer area that is provided within the RAM 812 corresponding to the recording heads H1 and H2. Thus, the above successive dot forming is implemented by the recording heads H1 and H2.

As described above, according to the first embodiment, if the nozzle N is in the inoperative state, the adjacent complement is performed by employing one or two nozzles out of its adjacent five nozzles. As for methods to determine a nozzle used for each adjacent complement, methods shown below can be provided as examples. In a first method, a nozzle for complement is determined at each occasion based on the data of accumulated discharge number of each nozzle which is counted in the defective nozzle complement unit 810 in FIG. 3. In the first method, the accumulated discharge number is to be averaged as much as possible. In this complement method, there is no limitation of the number of nozzles to be employed at each complement occasion, and it should be determined according to a diameter of a dot to be formed on a recording medium. That is, it may be possible to employ only the nozzle M. If the other complement nozzles are employed, combinations of different nozzles may be employed as described above. Depending on a diameter of a dot actually formed on a recording medium, only one nozzle may be used to perform complement.

In a second method, a nozzle for complement is determined at each occasion based on an accumulated discharge number of each nozzle and impact accuracy of adjacent nozzles. For example, in a case where an inoperative nozzle exists, the nozzle M which forms the same raster as the inoperative nozzle is determined as one of candidates to be employed for complement. Further, among the other adjacent nozzles, it is determined to employ as a candidate for complement at least one adjacent nozzle whose ink droplet is impacted onto the recording medium displaced to the side of the inoperative nozzle N. By sequentially employing the above plurality of candidates, a missing point due to the inoperative nozzle N is complemented. Also in this complement method, there is no limitation to the number of nozzles employed at each complement occasion. For example, when the nozzle M is employed, only the nozzle M can be singly employed. However, if the other complement nozzles are employed, a plurality of nozzles or one nozzle for complement can be employed.

Figure 5:
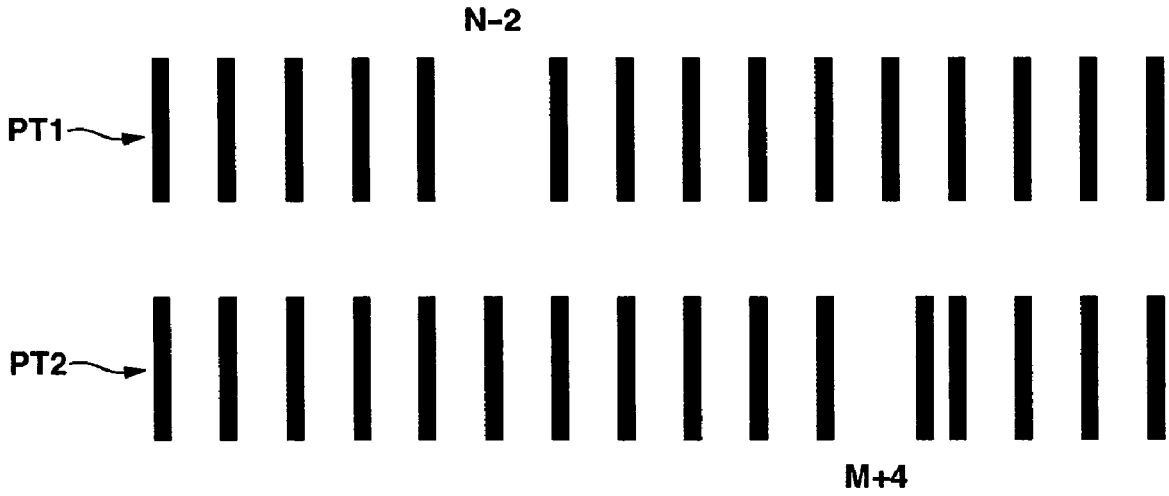
FIG. 5 illustrates an example of defective nozzle detecting patterns formed on a recording medium in a second method according to embodiments of the present invention.

In the second method, as data of impact accuracy of each adjacent nozzle, the defective nozzle detecting pattern measured and obtained by the defective nozzle detecting unit 811 in FIG. 5 may be used. Further, the defective nozzle detecting pattern data stored in advance in defective nozzle complement unit 810 in FIG. 3 may be used at the time of shipment of an apparatus or on other occasions. The use of the latest data of impact accuracy can be used because the data changes over time while recording heads are being used.

In addition, if the first method and the second method are combined, it is possible to average frequency of use and to perform a precise complement. That is, in the second method, after a plurality of nozzles including the nozzle M are determined as candidates to be employed for complement, the nozzles used at the time of complement are determined so as to average an accumulated discharge number of each nozzle selected as the candidates. With this method, a plurality of candidate nozzles can precisely complement a missing area formed by the inoperative nozzle N, and also it becomes possible to average the frequency of use of the plural candidate nozzles.

As described above, according to the first embodiment, a load on a nozzle used for complement is reduced significantly, and the deterioration of the nozzle can be reduced in comparison with the conventional technique of complement that utilizes only one nozzle.

In the above embodiment, two recording heads H1 and H2 are alternately utilized to form a raster. However, the present invention is not limited to the case where nozzles are alternately utilized, but each recording head can be utilized also in other orders. In that case, it is also possible to perform the above-described adjacent complement, and the same advantage as the above embodiment can be expected.

Second Embodiment

According to the first embodiment, the adjacent complement is performed by increasing the number of dots (the number of ink droplets) discharged from a nozzle adjacent to an inoperative nozzle. According to a second embodiment described below, the complement is performed by increasing an amount of an ink droplet discharged from each nozzle instead of increasing the number of dots (the number of ink droplets).

The second embodiment has a configuration illustrated in FIG. 1 to FIG. 4 similar to the above first embodiment. The head utilized in the embodiment is a so-called bubble jet type. The bubble jet type discharges ink using thermal energy generated by an electrothermal converting element, i.e. the heater 102, as illustrated in FIG. 2. In the recording head, bubbles are generated in ink by rapidly heating the ink with thermal energy, and the ink is pushed and discharged out of the discharge port 108 due to cubical expansion of the bubbles. Accordingly, the size of the bubbles can be adjusted by controlling a drive pulse to be applied to the heater 102, and an amount of the discharged ink (hereinafter referred to as discharge amount) can be controlled.

Figure 10A:
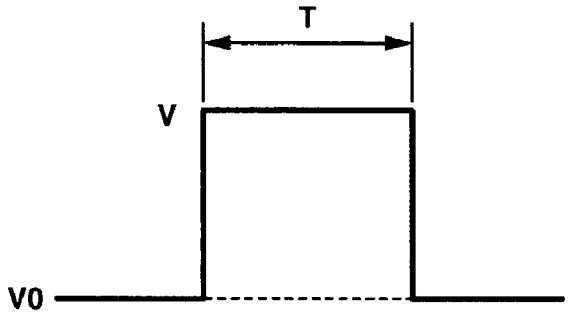
FIGS. 10A and 10B illustrate waveforms of drive pulses to be applied to a heater of a recording head.
Figure 10B:
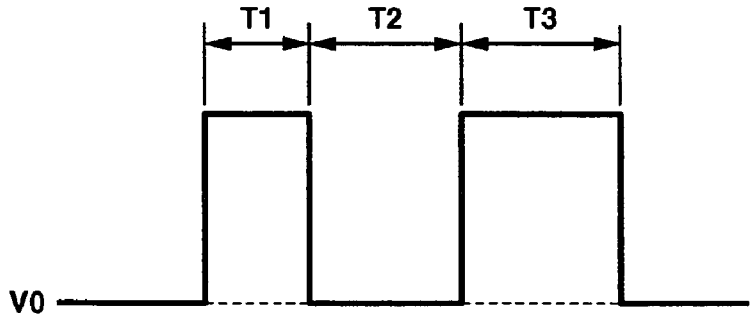

FIG. 10A and FIG. 10B show waveforms of drive pulses to be applied to the heater 102. FIG. 10A shows a pulse waveform in a so-called single pulse drive in which one drive pulse is applied to the heater 102 so as to form one ink droplet. FIG. 10B shows waveforms in a so-called double pulse drive in which two pulses are sequentially supplied to the heater 102 so as to discharge an ink droplet from the nozzle.

In the case of the single pulse drive in FIG. 10A, discharge amounts can be controlled by varying not only the voltage V-V0 but also the plus width T. Further, in the double pulse drive in FIG. 10B, the efficiency is high because the discharge amounts can be more widely controlled. In FIG. 10B, T1 represents a prepulse width, T2 is a down period, and T3 is a main pulse.

The reason that the efficiency of the double pulse drive is superior to the single pulse drive will be described below. In the single pulse drive, most of the heat value of the heater 102 is absorbed by the ink that comes in contact with the surface of the heater 102. Accordingly, a very large amount of energy has to be applied so as to form bubbles within the ink. In the case of the double pulse drive, by applying a prepulse, the ink itself is heated to some degree in advance, which subsequently helps main pulses to generate air bubbles.

Therefore, in the above double pulse drive, a discharge amount of a nozzle in an overlapped area can be adjusted by making the main pulse width T3 constant and the prepulse width T1 variable. As the prepulse width T1 becomes longer, the discharge amount increases, and as the prepulse width T1 becomes shorter, the discharge amount decreases. Accordingly, in order to control the discharge amount, the double pulse drive can be adopted.

Next, a method of controlling a discharge amount will be described that assigns a different prepulse width T1 to each nozzle in the double pulse drive.

As illustrated in FIG. 11, 2-bit data corresponding to the nozzles is written on an area A and an area B provided in the defective nozzle complement unit 810 in the control system for controlling a recording head (see FIG. 3). The four types of pulse widths illustrated in FIG. 12 from (a) to (d) can be selected using the 2-bit selection data. For example, in the case where a smallest discharge amount is set, by inputting selection data (0, 0), the narrowest pulse width, the prepulse PH1, is selected. Further, in the case where a largest discharge amount is to be set, by inputting selection data (1, 1), the widest pulse width, the prepulse PH4, is selected.

In the second embodiment, the prepulses PH1 to PH4 are supplied to the drive circuit 807 of a recording head by assigning the selected data to each nozzle. Further, the main pulse MH having a constant pulse width is supplied to the drive circuit 807 subsequent to an interval of down time T2. As described above, the ink discharge amount of each nozzle can be controlled by adjusting the pulses to be supplied. After the selected prepulses are applied to each nozzle of the recording head, the main pulse MH having a constant pulse width illustrated in FIG. 12 (*e*) is applied.

Figure 13:
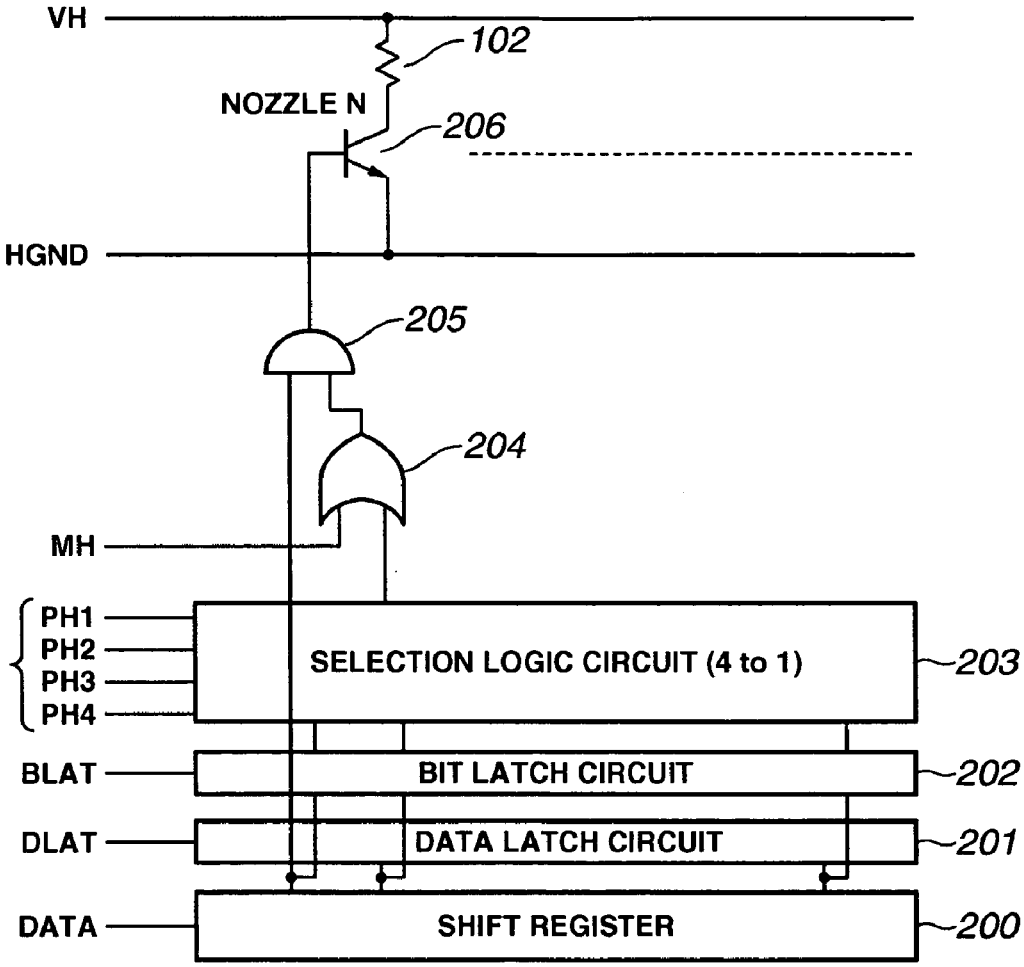
FIG. 13 illustrates an explanatory view showing a drive circuit of a recording head according to the second embodiment of the present invention.

With reference to FIG. 13, a configuration of the drive circuit 807 which controls discharge amounts of each nozzle utilizing the above-described double pulse drive will be described. In FIG. 13, a signal line VH is a power source of an inkjet head, HGND is a GND line corresponding to VH, MH is a signal line of a main pulse, and PH1 to PH4 are signal lines of the above-mentioned prepulses. BLAT is a signal line to latch bit data for selecting the prepulse PH1 to PH4 to a bit latch circuit 202, and DLAT is a signal line to latch the data (image data) that is necessary for recording to the data latch circuit 201. DATA in FIG. 13 is a signal line to transfer bit data and image data to the shift register 200 as serial data.

In the configuration illustrated in FIG. 13, the bit data (selection data) shown in FIG. 11 is transferred to the shift register 200 through the signal line DATA as serial data and sequentially stored. When the bit data of all nozzles is stored, the bit latch signal is inputted to the bit latch circuit 202 through the signal line BLAT, and the bit data is latched.

Then, the image data necessary for recording is stored in the shift register 200 through the signal line DATA in the same manner. When the data of all nozzles is stored, the DLAT signal is generated, and the data is latched. First, one of the prepulse PH1 to PH4 is selected and outputted from a selection logic circuit 203 based on the latched bit data. The selected prepulse signal and the main pulse signal MH are sequentially inputted and combined in the OR circuit 203 subsequent to the interval of down time T2, and further inputted to an AND circuit 205. In the AND circuit 205, the image data transferred from the shift register 200 and the pulse signal transferred from the OR circuit are subjected to an AND operation, and a high-level signal or low-level signal is inputted to a base of a transistor 206 provided corresponding to the heater 102 of each nozzle. When the high-level signal is inputted to the transistor 206, the transistor 206 is placed in a connected state, an electric current is applied to the heater 102 to generate heat, and the ink is discharged out of the nozzle. The above steps are applied to all nozzles.

Figure 12:
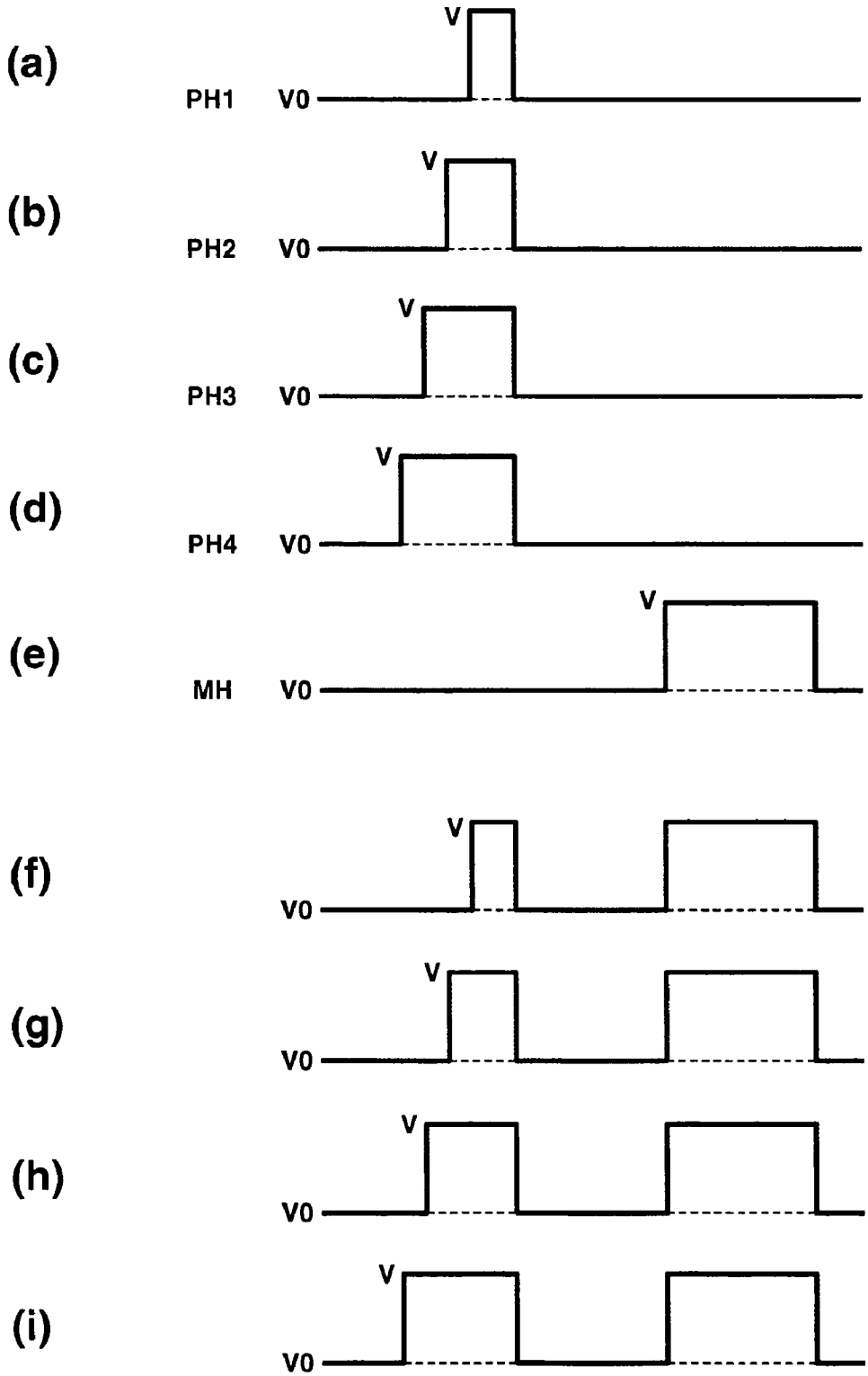
FIG. 12 illustrates waveforms of pre-pulses, a main pulse, and combined waveforms utilized at a time of double-pulse driving.

Combined waveforms of prepulse signal PH outputted from the OR circuit 204 and the main pulse signal MH are illustrated as (f) to (i) in FIG. 12. A discharge amount can be controlled by transferring the bit data corresponding to a desired discharge amount to the sift register 200 at a desired timing.

In the above example of driving, 2-bit data is utilized and four types of prepulse signals PH are selectable. However, it is possible to control a discharge amount more precisely by increasing the number of bits. In that case, the selection logic circuit 203 becomes more complicated.

Figure 9A:
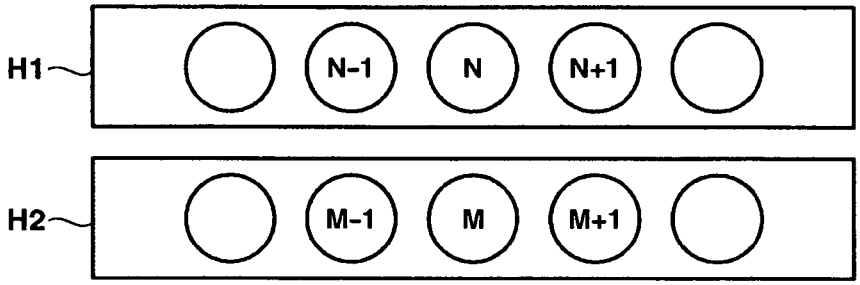
FIGS. 9A and 9B schematically illustrate a method for complementing an image according to a second embodiment of the present invention.
Figure 9B:
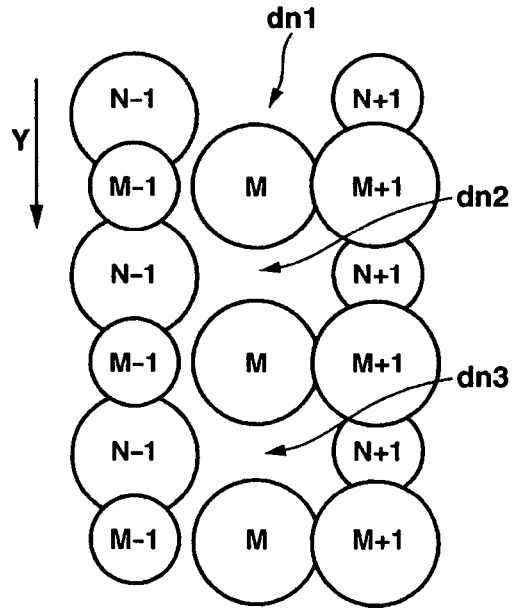

FIG. 9A and FIG. 9B illustrate schematically a method of complementing an image according to the second embodiment of the present invention. According to the second embodiment, a lack of an image due to an inoperative nozzle can be complemented by the above-described discharge amount control in a nozzle. When the nozzle N in the recording head H1 of the two recording heads shown in FIG. 9A is in the inoperative state, the three nozzles which are adjacent to the inoperative nozzle N, the nozzles M, M+1, and N−1, are employed to complement the inoperative nozzle N. The complement is performed by increasing the amount of ink discharged from these complement nozzles. If the nozzle N becomes inoperative and any complement is not performed, images are missing where dots are to be formed by the nozzle N, that is, dn1, dn2, and dn3. However, since dots are formed by the three complement nozzles discharging a large amount of ink around each missing area, dn1, dn2, and dn3, the images can be complemented by the spread of the dots.

According to the second embodiment, the complement is performed by increasing the discharge amount of the three nozzles, i.e. nozzles N−1, M, and M+1, and a nozzle to be employed for the complement can be selected using the first method or the second method described in the above first embodiment.

An optimum amount of the ink for the complement of an image formed by an inoperative nozzle is obtained on experiment in advance and its value is stored in a memory such as the defective nozzle complement unit 810. When the complement is performed, the optimum amount value is read from the memory, and a necessary drive pulse is supplied to each nozzle through the drive circuit 807.

Third Embodiment

According to the first embodiment, in order to complement a lack of an image that should be formed by an inoperative nozzle, the number of drive times of a nozzle adjacent to the inoperative nozzle is increased. According to the second embodiment, an amount of an ink droplet discharged from a nozzle adjacent to an inoperative nozzle is increased. In addition, the above first embodiment and second embodiment can be combined. In comparison with the control range of the discharge amount shown in the above second embodiment, the first embodiment which changes the number of ink droplets can vary an amount of ink discharged on a recording medium to a larger degree. However, in the case where the number of ink droplets should be controlled, the control of precise discharge amount becomes more difficult. Consequently, by combining the first and second embodiments, a discharge amount and the number of times of discharge can be properly controlled in response to a required discharge amount for complement. This enables performing complement with a wider dynamic range.

Fourth Embodiment

Figure 14:
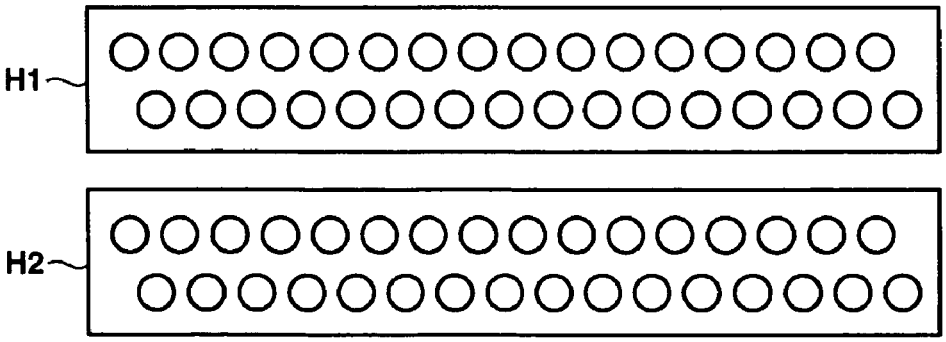
FIG. 14 illustrates other schematic structure of a recording head to which the present invention can be applied.
Figure 15:
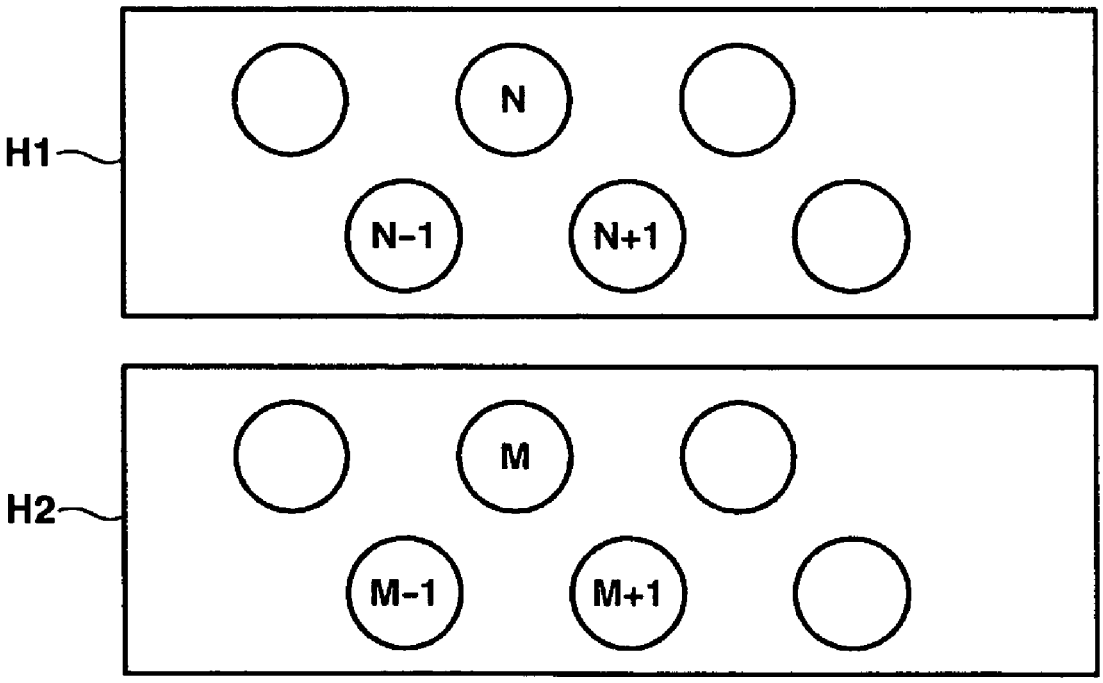
FIG. 15 is a partially enlarged view of the recording head shown in FIG. 14.

In the above embodiments, one nozzle line is arranged on each of the recording heads H1 and H2 as an example. According to the present invention, two lines of recording heads which discharge ink of the same color can also be configured as illustrated in FIGS. 14 and 15. FIG. 15 is a partially enlarged view of FIG. 14. Each recording head H1 and H2 in FIG. 14 and FIG. 15 has two nozzle lines arranged within one recording head. In the two nozzle lines formed within each of the recording heads, each nozzle of one nozzle line is arranged in a middle of adjacent nozzles of the other nozzle line, which forms a staggered arrangement as a whole. Each nozzle of the recording head H1 and that of the other recording head H2 are arranged in a same position in a direction intersecting with a conveying direction of a recording medium (Y direction), which enables both recording heads to form a same raster.

Accordingly, complement of an image can be performed using the recording head shown in FIG. 14 and FIG. 15 similar to the above first and second embodiments. For example, as illustrated in FIG. 15, if there is an inoperative nozzle N, complement is performed by employing nozzles N−1, N+1, and M+1.

In the above embodiments, a plurality of recording heads is provided which discharge the ink of the same color. However, all nozzle lines provided in the plurality of recording heads according to the above embodiments may be provided within the same recording head. For example, two pairs of staggered nozzles in FIG. 14 may be formed within the same recording head. In a case of this kind of recording head, the methods of complementing described above can also be applied.

As described above, according to the present embodiment, the complement of an image forming area corresponding to a defective nozzle is performed using a recording unit which has a plurality of nozzle lines and two or more of the nozzle lines are arranged on the same raster. According to the embodiment of the present invention, in a complement recording in the above configuration, it is possible to reduce a load on a particular nozzle and prevent its deterioration. Moreover, if a nozzle for complement is determined on the basis of a frequency of nozzle use or discharge characteristics such as an impact accuracy of a nozzle, the frequency of the nozzle use can be averaged surely, and more proper complement is possible.

Other Embodiments

According to the above embodiments, two recording heads which discharge ink of the same color are provided, the nozzles in each of the heads are opposed to each other in a direction of the raster, and the raster can be formed utilizing the nozzles of each recording head. However, the present invention is not limited to the case of two recording heads. For example, the present invention can be applied to a case where more than three recording heads which discharge the ink of the same color are provided in parallel with each other, or a case where one recording head is provided. In the case where three recording heads are provided in parallel with each other, if a defective nozzle appears in the middle recording head, nozzles adjacent to the defective nozzle become a first nozzle and a second nozzle, which are located on both sides of the defective nozzle. It may also be possible to employ a third nozzle, which forms the same raster as the defective nozzle, and fourth and fifth nozzles, which are located on both sides of the third nozzle for a complement recording. In this case, since there are recording heads upstream and downstream of the middle recording head, respectively, the third, fourth, and fifth nozzles exist in each of the upstream and downstream recording heads, respectively. Accordingly, a total of eight nozzles are adjacent nozzles to the defective nozzle. That is, all of or a part of the eight nozzles may be employed for complement, and an area where an image is to be formed by the defective nozzle can be complemented using the complement nozzles. In order to determine a nozzle to be employed for the area to be complemented, the same method described in the above embodiments can be applied.

Even if only one recording head is employed, by using nozzles located on both sides of a defective nozzle for complement, the life of recording heads increases in comparison with conventional art which uses one nozzle.

In the above embodiments, a heater is utilized as an energy generating unit for discharging ink droplets in a recording head. However, the present invention can be applied to an apparatus which utilizes an electromechanical conversion element such as a piezoelectric type as an energy generating unit for discharging ink droplets.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2004-381747 filed Dec. 28, 2004 which is hereby incorporated by reference herein in its entirety.

What is claimed is:

1. An inkjet recording apparatus comprising:

a recording unit including a plurality of recording heads arranged for ink of the same color, each recording head including a plurality of nozzles configured to discharge ink droplets, the nozzles of each recording head being arrayed along an arraying direction, the recording head being arranged in a direction different from the arraying direction of the plurality of nozzles, wherein the recording unit performs recording by discharging ink droplets on a recording medium from the nozzles while the recording unit and the recording medium are moving relatively in a direction intersecting with the arraying direction of the nozzles; and a complement unit configured to perform complement recording on a corresponding point on the recording medium where an image is to be formed by any defective nozzle of the nozzles arrayed in the plurality of recording heads, by employing one or more complement nozzles selected from the plurality of nozzles adjacent to the defective nozzle, wherein the plurality of recording heads are arranged so as to enable the nozzles arrayed in each of the plurality of recording heads to form a same raster, wherein the nozzles adjacent to the defective nozzle include first and second nozzles located on both sides of the defective nozzle in the recording head in which the defective nozzle exists, a third nozzle located on the same raster as the defective nozzle, and fourth and fifth nozzles located on both sides of the nozzle located on the same raster as the defective nozzle, wherein the complement nozzle includes one of: (i) one of the first to fifth nozzles and (ii) a plurality of nozzles selected from the first to fifth nozzles, and wherein the complement unit selects the third nozzle and at least one of the nozzle from the first, second, fourth and fifth nozzles as the complement nozzles.

2. The apparatus according to claim 1, wherein the complement unit selects a plurality of nozzles from the first to fifth nozzles except the third nozzle as complement nozzles.

3. The apparatus according to claim 1, wherein the complement unit selects the complement nozzles based on a frequency of use of each of the complement nozzles.

4. The apparatus according to claim 3, wherein the complement unit selects from the plurality of nozzles to be employed for complement recording so as to average a frequency of use of the complement nozzles.

5. The apparatus according to claim 1, wherein the complement unit selects the nozzles to be employed for complement recording on the basis of an impact accuracy of each of the complement nozzles.

6. The apparatus according to claim 1, wherein the complement unit selects the third nozzle and a nozzle whose impact point is displaced to a point where an image is to be formed by the defective nozzle, from the first to fifth nozzles, and wherein the complement unit selects complement nozzles to be employed corresponding to each point where an image is to be formed by the defective nozzle from the complement nozzles based on a frequency of use of the complement nozzles.

7. The apparatus according to claim 1, wherein the complement unit increases the number of ink droplets to be discharged from the complement nozzles to more than the number of ink droplets to be discharged from the defective nozzle in the complement recording of a point to be formed by the defective nozzle.

8. The apparatus according to claim 1, wherein the complement unit performs the complement recording by increasing an amount of ink droplets to be discharged from the complement nozzles.

9. An inkjet recording method which utilizes a recording unit including a plurality of recording heads arranged for ink of the same color and each having a plurality of nozzles configured to discharge ink droplets, the nozzles being arrayed along a predetermined direction and the recording heads being arranged in a direction different from the arraying direction of the plurality of nozzles, and the recording unit performing recording by discharging ink droplets on a recording medium from the nozzles while the recording unit and the recording medium are moving relatively in a direction intersecting with the arraying direction of the nozzle, the inkjet recording method comprising the steps of:

a step of selecting a plurality of complement nozzles from nozzles adjacent to any defective nozzle of the nozzles arrayed in the plurality of recording heads; and a complementing step of performing complement recording on a corresponding point on the recording medium where an image is to be formed by the defective nozzle by utilizing the complement nozzles, wherein the plurality of recording heads are arranged so as to enable the nozzles arrayed in each of the plurality of recording heads to form a same raster, wherein the nozzles adjacent to the defective nozzle include first and second nozzles located on both sides of the defective nozzle in the recording head in which the defective nozzle exists, a third nozzle located on the same raster as the defective nozzle, and fourth and fifth nozzles located on both sides of the nozzle located on the same raster as the defective nozzle, wherein the complement nozzle includes one of: (i) one of the first to fifth nozzles and (ii) a plurality of nozzles selected from the first to fifth nozzles, and wherein the complement unit selects the third nozzle and at least one of the nozzle from the first, second, fourth and fifth nozzles as the complement nozzles.

* * * * *